US010626527B2

(12) United States Patent
Bruske et al.

(10) Patent No.: US 10,626,527 B2
(45) Date of Patent: Apr. 21, 2020

(54) METHOD AND DEVICE FOR PRODUCING A REED, AND REED

(71) Applicant: Groz-Beckert KG, Albstadt (DE)

(72) Inventors: Johannes Bruske, Albstadt (DE); Thomas Lindner, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 151 days.

(21) Appl. No.: 15/557,025

(22) PCT Filed: Mar. 9, 2016

(86) PCT No.: PCT/EP2016/055009
§ 371 (c)(1),
(2) Date: Sep. 8, 2017

(87) PCT Pub. No.: WO2016/142418
PCT Pub. Date: Sep. 15, 2016

(65) Prior Publication Data

US 2018/0057980 A1 Mar. 1, 2018

(30) Foreign Application Priority Data

Mar. 10, 2015 (EP) ..... 15158490

(51) Int. Cl.
*D03D 49/62* (2006.01)
*D03D 47/27* (2006.01)
*D03D 49/00* (2006.01)

(52) U.S. Cl.
CPC ..... *D03D 49/62* (2013.01); *D03D 47/277* (2013.01)

(58) Field of Classification Search
CPC .... D03D 13/004; D03D 13/008; D03D 15/04; D03D 41/00; D03D 49/62; D03J 1/14
See application file for complete search history.

(56) References Cited

U.S. PATENT DOCUMENTS 2,572,365 A * 10/1951 McFetters ..... D03D 49/62 139/192
2,783,780 A * 3/1957 Wagner ..... D03D 49/62 139/192

(Continued)

FOREIGN PATENT DOCUMENTS

CN 202989445 U 6/2013
CN 203229717 U 10/2013

(Continued)

OTHER PUBLICATIONS

International Search Report in corresponding International Application No. PCT/EP2016/055009, dated Jun. 9, 2016, 6 pages.

(Continued)

*Primary Examiner* — Robert H Muromoto, Jr.
(74) *Attorney, Agent, or Firm* — Fitch, Even, Tabin & Flannery LLP

(57) ABSTRACT

A method for manufacturing weaving reeds (9) includes forming the dents (1) of the reed (9)where strip- or tape-shaped objects (1) are joined together at a given distance apart (A) in the widthwise direction (B) of the reed (9). At least one of the strip- or tape-shaped objects (1) is provided with a prescribed amount (10-18) of at least one viscous substance applied to its areal surfaces (8), particularly to the end portions (E) thereof, said areal surfaces facing in the widthwise direction (B) of the reed (9), and are then joined together. A device (30) for manufacturing reeds (9), and a reed (9) produced using the aforementioned method is included.

15 Claims, 4 Drawing Sheets

(56) References Cited

U.S. PATENT DOCUMENTS

| | | | | | |
|---|---|---|---|---|---|
| 2,989,088 | A * | 6/1961 | Schmidt | D03D 49/62 | 139/192 |
| 3,189,056 | A * | 6/1965 | Parks | D03D 49/62 | 139/192 |
| 3,965,940 | A * | 6/1976 | Marty | D03D 49/62 | 139/192 |
| 4,519,098 | A * | 5/1985 | Dunmire | A41D 19/015 | 2/161.8 |
| 5,878,599 | A * | 3/1999 | Halassek | D04B 27/06 | 66/214 |
| 6,009,729 | A * | 1/2000 | Halassek | D04B 27/06 | 66/214 |
| 6,409,030 | B1 * | 6/2002 | Schlemper | D05C 15/20 | 112/80.45 |
| 7,055,347 | B2 * | 6/2006 | Bruske | D04B 27/06 | 66/1 R |

FOREIGN PATENT DOCUMENTS

| | | | |
|---|---|---|---|
| DE | 2150275 | A1 | 4/1972 |
| DE | 2226194 | A1 | 12/1973 |
| EP | 1967624 | A1 | 9/2008 |
| JP | S49101664 | A | 9/1974 |
| JP | S50121563 | A | 9/1975 |
| JP | 2001003240 | A | 1/2001 |

OTHER PUBLICATIONS

Second Office Action in corresponding Chinese Application No. 201680014721.5, dated Jan. 16, 2019, with English Translation, 14 pages.

European Search Report and Written Opinion dated Aug. 21, 2015, in corresponding EP Application No. 15158490.1, 8 pages.

European Examination Report dated Feb. 26, 2019, in corresponding EP Application No. 15158490.1, with English translation, 9 pages.

International Preliminary Report on Patentability in corresponding International Application No. PCT/EP2016/055009, dated Sep. 12, 2017, 9 pages.

First Office Action in corresponding Chinese Application No. 201680014721.5, dated Jun. 11, 2018, with English Translation, 13 pages.

Chinese Third Office Action dated Jul. 11, 2019, issued in corresponding Chinese Patent Application No. 201680014721.5 (4 pages).

Japanese Search Report dated Nov. 29, 2019 and Notice of Reasons for Refusal dated Dec. 25, 2019, in corresponding Japanese Application No. 2017-547416, with English translation (18 pages).

* cited by examiner

METHOD AND DEVICE FOR PRODUCING A REED, AND REED

CROSS REFERENCE TO RELATED APPLICATIONS

This patent application is the national phase of PCT/EP2016/055009 filed Mar. 9, 2016, which claims the benefit of European Patent Application No. 15158490.1 filed Mar. 10, 2015.

TECHNICAL FIELD

Reeds and reed manufacturing methods are known. In prior-art weaving processes, reeds serve to press the weft thread that has just been inserted through the shed against the already woven cloth. For this purpose, the reed has a row of dents arranged sequentially in the reed's widthwise direction. Gaps between these dents provide room for the warp threads. As a rule, the dents are bounded by frame members of the reed so that the reed has a certain degree of stability and manageability. These frame members are usually U-shaped and consist, for example, of light metal.

A number of manufacturing methods for reeds of this kind have become known and are listed, among other publications, in DE 2 226 194 A:

BACKGROUND

According to one method, it is customary to first of all wind wires around the end portions of the dents with the aid of semi-circular rods. For one thing, the wires define the distance between the dents that is required to give the warp threads the necessary room during the weaving process. For another, the wires also establish the first mutual attachment between the dents. In a further processing step, the ends of the dents are inserted into a U-shaped profile and embedded therein, preferably with synthetic resin or other adhesives, thereby creating the aforementioned frame members of the reed. In addition to setting the aforementioned gap width by winding wires around the dents, spiral springs are pressed between the edges of the dents to assist in accurately setting the desired distance between them. These spiral springs and the semi-circular rods with the wires are subsequently covered with a layer of adhesive that is flush with the reed's frame members. The wires for winding around the dents and for the spiral springs must have a highly uniform diameter and must be kept in stock for every required dent spacing. The winding procedure has to be constantly monitored on account of unavoidable fluctuations in the wire diameter and thickness of the dents. The spiral springs have to be inserted manually.

Another method of manufacturing reeds, which is described in the aforementioned publication, consists in inserting or glueing spacers between the dents in order to set the gap width. The ends of the dents remain free and are subsequently glued to the reed's frame members. The spacers are then removed again or dissolved away.

JP 2001 003240 A describes work stages for producing a reed. Once the dents of the reed in question have been mutually spaced apart and fixed in position by way of work stages that are not disclosed in detail, thread eyes are produced between each pair of dents by extruding adhesive in the gap between the dents concerned. DE 2150 275 A1 discloses another method of producing a reed, in which, to start with, portions of the reed's frame members, which consist of thermoplastic polymer, are softened by heating them. The dents are then pressed into these portions.

Among the disadvantages of the described methods are that, in order to accurately obtain the required distance between adjacent dents, they use or should use expensive spacers, which furthermore imply a measure of tolerance. These semi-finished products are tedious to insert and a wide range of types has to be kept in stock. High costs are the natural consequence.

With the last-mentioned method, these spacers have to be removed again from the gaps between the dents, which leads to further inaccuracies in the dent spacing. In addition, the methods cited are not cheap—again on account of the necessity of inserting expensive spacers.

SUMMARY

In view of this situation, the objective of the present invention is to provide an inexpensive and accurate method of producing a reed, along with a device for doing so.

The objective is achieved via a method in which the dents are provided with a prescribed amount of a viscous substance in order to accurately set the required distance between them and to initially fasten them together. Reeds produced in this way boast more uniform dent spacing because no spacing tolerances are introduced by semi-finished products and the method of their insertion.

The dents are strip- or tape-shaped. The length of the dents is determined by the geometry of the shed and the movement of the dents relative to the shed. The longitudinal direction of dents installed in the loom corresponds essentially to the elevational direction and is perpendicular to the warp threads. The length of the dents must, for one thing, offer sufficient room for warp-thread movement. In addition, it must be possible to embed the end portions of the dents in the reed's frame members, thereby stabilizing the reed. Particularly in the case of high-density reeds, the thickness of the dents, which is measured in the reed's widthwise direction, is of the same order of magnitude as the gaps between the dents and, like the width of the dents, is partly determined by the reed's stiffness requirements. In the case of reeds of lower density, the ratio of dent width to gap width may shift, so that the gap accounts, for example, for 70% of the distance made up of the dent thickness plus the gap width. The dents for reeds in air-jet looms may be specially shaped on the fabric side in order to form an air channel. What all dents have in common is that they only have two opposite sides with a surface area of some magnitude. The other sides of the dents are merely narrow edge entities.

To manufacture the reed, the dents are advantageously arranged in a row such that they are mutually superposed, with their areal surfaces opposite one another. A specified amount of a viscous substance is applied to these surfaces, in particular to the end portions thereof, which are later covered by the reed's frame members. For one thing, this applied substance keeps the dents spaced apart. For another, if, for example, the substance is an adhesive, it enables the dents to be joined together permanently.

In order that the aforementioned inter-dent gap formed by application of the viscous substance is the right size, the amount of substance applied must be exactly in keeping with a specified quantity. It is advantageous in this context if the metering device is able to meter the right amount of viscous substance, i.e. to portion it. As a rule, this portioning is carried out before the dents are brought together. Usually, it is also carried out in a manner that does not envelop the dents. Instead, an amount that is specified prior to application is applied to one areal surface of the dent concerned. This specified amount may be communicated to the metering device by the operator, for example. It is advantageous to use control equipment for the metering device, which determines the specified amount on the basis of the substances used and the required distance between dents and/or of other data.

If the substance is applied dropwise, for example, the height of the drop on the surface of the first dens to which it was applied determines the distance between the first dent and the next dent when these are joined together. It must be taken into consideration in this context that the shape and accordingly also the height of the drop may change a number of times depending on its contact properties (e.g. wetting). Once the viscous substance has wetted the first dent, the drop will assume a specific shape at the bounding surface. After the first dent has been brought into contact with the second one, the drop will also assume a specific shape of this kind at the second bounding surface. The height of the drop, now enclosed and deformed between two surfaces, will change according to its volume. As described further on, the height, and accordingly also the shape, of the drop may be selectively altered on bringing the dents into mutual contact.

As a rule, methods according to the invention specify a volume or a weight, which is used to space two dents apart. These volumes often space apart a reed's dents successively. The prior-art methods described above often make use of adhesives—i.e. viscous substances—to embed the wire or other solid bodies used to space the dents apart, and thus to fix the dents in position. However, these methods do not use prescribed volumes analogous to those of the present invention. Furthermore, they do not use viscous substances, irrespective of how the quantities thereof are determined, to (initially) set the distance between the dents.

The viscosity of the substance used must be high enough to enable the applied substance to maintain the required distance between the dents. On the other hand, the viscosity must not be so high that the substance can no longer be applied in the prescribed amount due to lack of fluidity. The substance may be applied by means of a metering device that uses screws, pressure surges, thermal or piezoelectric actuators or other systems to transport the substance. These may of the kind used, for example, in inkjet printers. Each different system can process substances of a certain viscosity. It is advantageous if, during processing of this substance or its application to the dents, its viscosity (and accordingly its fluidity) moves within a range in which the prescribed amount of the viscous substance can be portioned out. On the other hand, it is advantageous if, at this point in time or by a foreseeable time following application of the substance, the viscosity is high enough to keep two dents permanently spaced apart. A whole range of adhesives, but also of resins and paraffins, satisfy these requirements. It is often necessary to set a temperature range or other physical environmental parameters in order to bring the physical or chemical state of the viscous substance into the state in which the substance can be processed in this way. It follows from the aforementioned facts that thermoplastics and mixtures of mutually reactive substances may also be considered to be viscous substances as defined in this publication.

It is accordingly advantageous in all embodiments of the invention if the prescribed amounts of the initially viscous and, during its processing, portionable substance used to establish the original inter-dent spacing is still between the dents in the finished reed. This also applies to cases where the end portions of the joined-together dents are covered with an additional viscous substance, which also cures. Both the aforementioned substances—the prescribed amount of originally viscous substance plus a quantity of embedding compound—occur in the last-mentioned instance. Naturally, this applies particularly to the end portions of the dents. In these end portions, in particular, these two substances may occur in the immediate vicinity of each another or in direct contact with each other. It is frequently likely that the prescribed amount of the first substance is surrounded by the embedding compound.

A manufacturing method according to the invention may be advantageous particularly for high-density reeds (for example, 50 dents per cm or more) because the appropriate amounts of substance [for example, 500 pl (pictoliters) or less] can be applied with high repeat accuracy and the variation thus kept below that of the semi-finished products used otherwise.

The specified amount of viscous substance may be applied dropwise, in punctiform manner, in the form of a bead or by spreading it to form an expanse. It should be ensured that the dents are exactly spaced apart over the entire extent of their length and breadth, thereby ensuring the parallelism of the surfaces as a whole. As described before, the height of the applied substance—at least in its cured state—defines the inter-dent spacing. The surface area of the applied substance may influence the time required to apply the viscous substance, making larger surface areas proportionately more expensive. Larger areas may possibly improve the parallelism of the dents and the strength of the adhesive bond. The configuration of the applied substance influences the remaining dent surface area available for adhesive bonding later to the reed's frame members and may also influence the flow properties during subsequent bonding to the frame members. Individual configurations are shown, and their effects discussed, in the illustrative embodiments.

As a rule, the dents are made of steel. During reed production, the dents may be unwound directly from a coil of dent strip and cut to length. The prescribed amount of viscous substance is then applied to one areal surface of an individual dent. The dent surface to which the viscous substance has been applied is now brought into contact with another dent. There are other advantageous possibilities, too, regarding the timing of the first two aforementioned steps: the viscous substance may also be applied to the future dent before it is cut to length. Generally speaking, it is also possible to apply the viscous substance at any time during the process at which the areal surface can be supplied with viscous substance, irrespective of whether the dent is simultaneously undergoing a transport step or some other advantageous or necessary process step or is being cut to length. An important prerequisite for uniform application of viscous substance to the areal surface is its accessibility to the metering device. The viscous substance may also be applied advantageously to the last-fitted dent. Where more than one metering device is used, viscous substance may also be applied to both the dents scheduled to be brought together in the next step.

As a rule, however, a reed according to the present invention is produced by successive applications of viscous substance. One or more applications thereof serve to establish the required spacing between two dents. In prior-art methods, the spacing between dents is effected with solid bodies, which are then simultaneously embedded in the reed's upper and lower frame members. It is not the intention, in the case of a reed manufactured according to the invention, to exclude simultaneous embedding in a frame member.

The first permanent connection between dents may be produced with an adhesive, which is applied in initially viscous form and in the prescribed amount. Special preference is given to adhesives with curing properties that may be selectively influenced. Once the adhesive has cured, the joined dents can be routed to further processing steps, for example adhesive bonding to the reed's frame members, without any risk of the dent spacing or parallelism being impaired by a transport process.

It is additionally advantageous if adhesives are used whose curing properties can be influenced by energy input. Adhesives may be used which, for example, cure faster under the influence of UV light or high temperature. The use of adhesive systems that are activated in other ways, or of fast-curing adhesives, is also conceivable. Thus, substances activated by the aforementioned energy input are advantageous. By activation is meant, for example, the triggering of a chemical reaction.

According to a particularly advantageous method, a plurality of different viscous substances is applied. The different viscous substances may be applied in a joint process step. The different viscous substances may have different curing properties.

For example, a first viscous substance may be a distancing material that cures directly on application, serving only as a spacer and having no adhesive effect. A paraffin is a possible example of such a material. The cured distancing material should be strong enough for it to keep the dents reliably spaced apart, for example against capillary forces.

It is particularly advantageous to use distancing materials that may be washed out of, or otherwise removed from, the reed once the bonding material has cured. Solvents or heat, for example, may assist in or effect the washing out or removal of distancing material. The use of distancing materials that can be washed out offers the additional possibility of also applying inter-dent "spacers" in the area in which, during weaving, the warp threads pass through, and thereby facilitating, to great advantage, establishment of the required spacing and parallelism.

As described above, a second viscous substance may be an adhesive. In order to permanently join two dents together, the adhesive must not cure before the one dent has been brought into contact with another dent. The distancing material may be selected such that it cures faster and has already reached its final strength before the dents are joined. The dents may then be pushed together until the distancing material prevents closer proximity, and the adhesive then allowed to cure. As mentioned above, curing of the adhesive may be initiated or assisted by means of energy input or other methods.

It is also conceivable to use more than two different viscous substances. It may be advantageous, for example, to use a plurality of different substances as distancing material. In the area in which the warp threads pass through during weaving, only such distancing materials as can be washed out or removed again are possible (because their removal is a must). In the end portions, which are covered by the reed's frame members, it would also be possible to use distancing materials that cannot be washed out again. Advantageous distancing materials also include viscous substances that can still be deformed plastically after curing. This advantage is of importance, for example, in the automatically controlled methods described later.

Particularly in cases where a plurality of viscous substances is used, there is the additional possibility of using a different prescribed amount of each of the viscous substances. The prescribed amount may, for example, be selected such that the faster-curing distancing materials have a lesser height, as measured from the dent's areal surface, than does the applied adhesive. It can be ensured in this way that the distancing materials establish the correct spacing and that the adhesives wet the dents to which adhesive was not directly applied sufficiently to guarantee that the adhesive bond is strong enough. The contact pressure during the joining step must be high enough to displace the viscous adhesive sufficiently for both dents to make contact with the distancing materials. As mentioned above, it is also possible to use more than two different viscous substances and to use a different prescribed amount of each. The prescribed amount of viscous substance may also vary according to whether, for example, it is being applied to the end portion of the areal surface or to its central portion, where the warp threads pass through during weaving.

During joining of the dents, it may be useful to monitor the size of the gap between the dents meteorologically and to set up a control loop for its precise adjustment. Measurements may be effected optically, for example, but any other suitable measuring method is also conceivable. A number of advantageous procedures exist with regard to the closed-loop control system:

The control system may, for example, be based on the use of distancing materials that are deformable (e.g. plastic deformation) in the cured state, too. By adjusting the contact pressure on the new dent to be joined to the existing one, or by adjusting the position of the dents relative to one another, distancing materials of this kind may be deformed (plastically) until the required inter-dent distance has been obtained.

It must also be considered advantageous to adjust the prescribed amount of the viscous substance(s) as a function of the current measured value prior to the next application of the viscous substance(s).

A combination of the two aforementioned control variables or the inclusion of additional control variables is also conceivable.

It may also be advantageous to use a method in which the distance between dents is adjusted by appropriate control of the handling device used to bring them together. For example, the last-attached dent may be held by the handling device until the first adhesive bond has cured. The prescribed amount of adhesive must be selected to be of a size sufficient to reliably wet both dents and to bond them together once it has cured. A distancing material would then be unnecessary.

A device according to the invention for manufacturing reeds is essentially characterized by a metering device set up for the purpose of applying one or more viscous substances to a dent. It is advantageous if the amount of each viscous substance to be applied and/or the amount for each application process can be prescribed separately. The metering device may apply viscous substance according to one of the aforementioned principles and may be equipped with a heating system, in particular for distancing materials. Additional units that assist in metering out the required viscous substances may be provided.

Advantages are offered by a first handling device, which positions the dents ready for viscous-substance application to the areal surface. A device for unwinding strip and cutting it to length and/or a repository for individually prepared dents may precede this handling device. A stock of dents in a repository is particularly advantageous for dents of air-jet looms, the geometry of which includes an air channel. This first handling device is set up to position the dents ready for coating. To enable application of one or more viscous substance(s) to every part of the dent's areal surface, the dents in the coating position and/or the metering device must be movable relative to one another along at least two axes. In addition, a further axis for adjusting the distance between the dent in its coating position and the metering device may be provided, or other axes. At least a second handling device may be provided. This collects the coated dent from the coating position and brings its coated surface into contact with a previously fitted dent. As described above, this second handling device may be set up such that the relative position in which the newly coated dent is brought into contact with the preceding one can be prescribed individually for each dent.

A reed according to the invention has, between each two adjacent dents, at least one body comprising a prescribed amount of a cured, originally viscous material, which is in contact with an areal surface of each of the adjacent dents. This or these bodies, or some of them, may form a permanent adhesive bond between the dents and/or set the size of the gap between the dents. It must be taken into consideration here that the volume of the cured material may differ from that of the less viscous material.

This or these bodies may assume various shaped geometries, such as drops, beads or other geometries (see before), and may cover differently sized areas of the dents' areal surfaces. The body or bodies, which comprise(s) a prescribed amount of a cured, originally viscous material, is/are located in the end portions of the dents. In the context of the present invention, the end portions of the dents are the outer portions thereof, as seen in the longitudinal direction, which are covered by the reed's frame members. The longitudinal direction of dents installed in the reed corresponds to the reed's elevational direction. It is advantageous if, at least in the end portions, to which the reed's frame members are fixed, areas exist between adjacent dents in which there are adhesives or other fastening means (e.g. solder or the like) with which the reed's frame members are fixed to the dents.

As a rule, a plurality of bodies made of a prescribed amount of a cured, originally viscous material are located between adjacent dents. At least some of these bodies preferably have the same volume. Bodies of this kind with identical volumes are obtained particularly in cases where the viscous substance was applied in punctiform manner or in other geometries with a small surface area. The volumes then differ only in the order of magnitude dictated by the metering device's tolerance limits. This means that, if only these bodies are used for spacing purposes and if, for example, no automatically controlled variant of the reed-manufacturing method was selected, the uniformity of the dent spacing will depend on the precision of the metering device. The variation in the size of the gap between adjacent dents, which derives from the variation in the size of the bodies made of cured, originally viscous substance, leads to smaller spacing inaccuracies than does use of the routinely used semi-finished products such as wires or wire coils. A certain percentage of solid bodies may be added to the viscous substances and may assist in maintaining the correct spacing. Other additives too, which are familiar from adhesives technology, may be added to the viscous materials. However, it may also be advantageous to work without solid bodies in the viscous materials, in particular if, as described earlier, a process is used which incorporates a closed- or open-loop control system.

The reed has a peripheral portion/frame area in which the dents are connected with each other but also with one or more profiles attached from the exterior. These profiles may be bonded to the dents, as already mentioned earlier. These profiles are bonded to the dents after the latter have been initially attached to one another. The profiles confer greater stability on the reed and enable it to be fixed to the sley without exerting force directly on the dents. In prior-art reeds, a symmetric, U-shaped profile is often used at the top and the bottom of the reed. Wrapping the dents according to the prior-art method usually results in the dents being embedded/bound symmetrically on the warp-thread entry and exit sides, i.e. in the same elevational position. Asymmetric wrapping in this context may cause the wires to slip, which is why dents wrapped asymmetrically in this way are not mentioned anywhere in the prior art. The reed according to the invention may have a frame with a profile that is, in end effect, asymmetric. A single, asymmetric profile is conceivable, but so are two or more flat or L-shaped profiles in the form of plate-like objects, which are attached in the peripheral area. The periphery of the reed may include gaps between the profiles and may also be completely open at the top, in which case the dents are not covered by an additional profile here. The individual profiles or plates may have extensions in order that, during a possible bonding process, the adhesive can be guided selectively or prevented from escaping. One possible arrangement is that, in the upper peripheral portion, nearer the warp beam, the profile reaches less far from above into the central area of the dents. However, any other configuration in which, at the top or the bottom of the reed, the front or rear frame member reaches to a greater or lesser extent into the central area is also conceivable. A measure of this kind enables the overall height of the reed to be reduced, preferably by adapting the dimensions of the peripheral portion to the particular shed geometry and to the reed's movement relative to the shed geometry. The peripheral portion/frame area in this context is the part of the reed, as seen in the elevational direction, in which the warp threads cannot pass through unhindered. The reason for this may be the reed's frame or—in prior-art reeds—the spiral springs or the wrapping wire. The reducible overall height of the reed according to the invention improves the stability of the reed when in operation in the loom. This applies particularly in the case of high rotary speeds. The overall height is measured in the elevational direction and denotes the reed's maximum extension in this direction.

The use of a plurality of objects to form the profiles for the peripheral portion may be advantageous, for example during bonding. During the fitting of individual plates, adhesive, which may have been applied prior thereto, can be pressed into the space available for it more easily than with a U-shaped profile, thereby enabling the space to be filled completely. A further advantage is that different materials or thicknesses may be used for the various plates. The frame members' stiffness, for example, may be selectively adjusted, and other material properties, too, may be selected arbitrarily. A spatial direction in this context is a direction in space. It is often beneficial if these spatial directions are mutually perpendicular.

BRIEF DISCRIPTION OF THE DRAWINGS

The present invention will now be explained in more detail on the basis of embodiments thereof and the drawings. Advantageously, the features described for the individual embodiments generally apply to the invention in its most general form.

DETAILED DESCRIPTION

Figure 1:
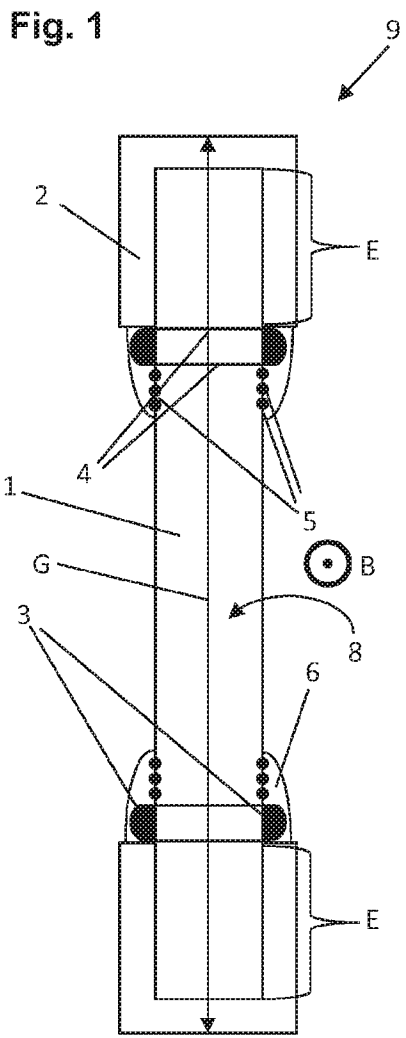
FIG. 1 is a sectional diagram of a prior-art reed, as seen looking at an areal surface of a dent.

FIG. 1 is a sectional diagram of a prior-art reed 6, as seen looking an areal surface 8 of a dent 1. This viewing direction corresponds to the widthwise direction B of the reed 9. The dent 1 is bounded in each case at the top and bottom by a frame 2 of the reed 9, the frame 2 being executed as a U-shaped profile. The adhesive joining the dent 1 and frame 2 of the reed 9 is not shown. This adhesive is in the space, which again is not shown, between the U-shaped profile and the dent 1 and, to some extent, between the areal surfaces 8 of adjacent dents 1. The semi-circular rods 3 adjoining the frame 2 of the reed 9, as well as the wires 4 wound around the rods 3, are also shown. In addition, the diagram shows three spiral springs 5 adjoining each of the semi-circular rods. The spiral springs 5 and the semi-circular rods 3 are masked by a covering of adhesive 6, which is flush with the frame 2 of the reed 9. Many prior-art embodiments are known, which differ, for example, in the number of spiral springs. Moreover, these spings 5 are sometimes also located in the frame 2 of the reed 9, within the U-shaped profile. However, all the possible prior-art variants have two features that impair their quality: firstly, the wire 4, which is wrappped around the dents 1 and the semi-circular rods 3, confines adhesive introduced into the frame 2 of the reed 9 inside the frame 2, and the dents 1 are not bonded between the wires 4 and the spiral springs 5; secondly, the dents 1 are clamped between the semi-circular rods 3 by the wire 4, so that, on account of the inevitable variation in the width of the dents 1, individual dents 1 are either not anchored properly (in the case of narrower dents 1) or are bent (in the case of broader dents 1).

Figure 2:
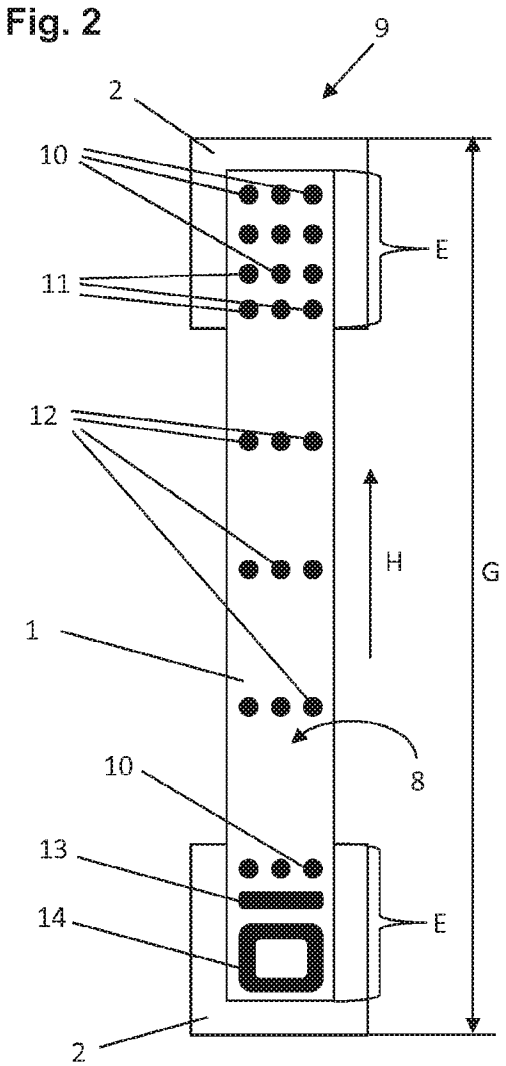
FIG. 2 is a sectional diagram of a reed according to the invention, as seen looking at an areal surface of a dent.

FIG. 2 is a sectional diagram of a reed according to the invention, as seen looking at an areal surface 8 of a dent 1. In this first illustrative embodiment, as in all the following illustrative embodiments according to the invention, it is first of all evident that no semi-circular rods 3, wires 4 or spiral springs 5 are required, and therefore no adhesive bond 6 to cover them. Accordingly, it is immediately recognizable that the interspace between the frame members 2 of the reed 9 is larger in the elevational direction H while the overall height G remains the same. This may be used to advantage in that the reed 9 according to the invention may be designed with a smaller overall height G, a measure which, considering the forces of inertia that prevail during weaving, can increase the service life and reduce the load on the loom.

To simplify the drawing, no free space between the frame 2 of the reed 9 and the dent 1 is shown in FIG. 2. The adhesive with which the frame 2 of the reed 9 is bonded to the dents 1 has also been omitted to simplify the drawing. Twelve circles are shown within the upper frame 2 of the reed 9, which are denoted as adhesive drops 10 or punctiform spacers 11. The number of circles, their form of arrangement and their designation as adhesive drop 10 or punctiform spacer 11 have been selected at random here and may be adapted arbitrarily to the requirements made on the reed 9 in question. In particular, it is possible to use only adhesive drops 10. The different adhesive drops 10 or punctiform spacers 11 may, moreover, comprise different materials if this is beneficial to the specific application. The same applies to the area within the lower frame 2 of the reed 9 in FIG. 2. Here, by way of example, an adhesive/spacer bead 13 in extended form is shown, along with an adhesive/spacer bead 14 in closed form.

In the central portion as seen in the elevational direction H of FIG. 2, i.e. in the portion between the two frame members 2 of the reed 9, nine circles are shown. These are referred to as punctiform spacers 12 in the interspace. Here too, the arrangement in three rows of three punctiform spacers each is arbitrary. Any other arrangement would be possible for all the illustrative embodiments. The possibility of these "punctiform spacers", although denoted as such, also having an adhesive effect is furthermore not ruled out. What is important in this central portion, in which, in the loom, the warp threads are guided between the dents 1, is that, on completion of reed manufacture, the spacers can be removed largely free of residues.

Figure 3:
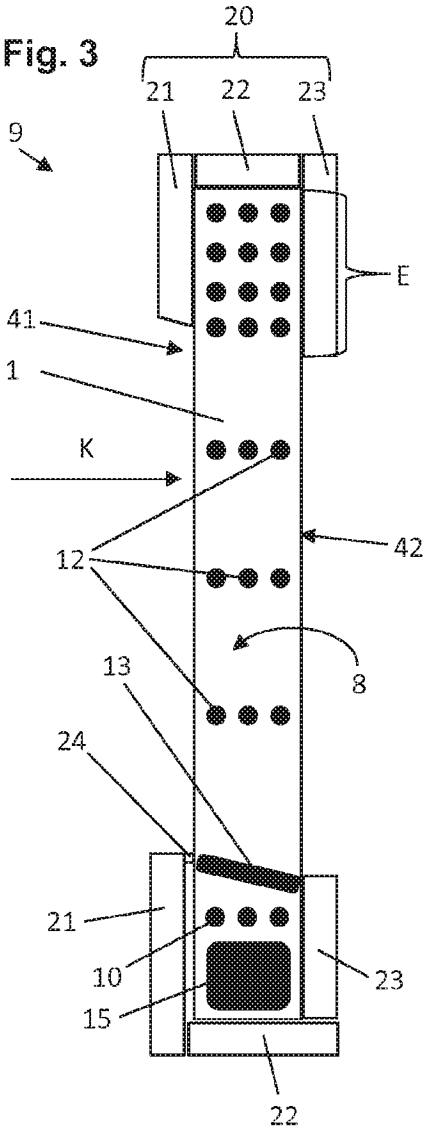
FIG. 3 is a sectional diagram of a further reed according to the invention, as seen looking at an areal surface of a dent.

FIG. 3 is a sectional diagram of a reed 9 according to the invention, as seen looking at an areal surface 8 of a dent 1. The display of adhesive drops 10 and punctiform spacers 11 within the lower frame 2 of the reed 9 differs to that in FIG. 2. The adhesive/spacer surface 15 shows a further alternative for applying the substance in question. The extended adhesive/spacer bead 13 has been applied at an oblique angle to the lateral edges of the dent 1. A special configuration of this kind may serve to prevent the adhesive applied inside the frame 2 of the reed 9 for its later anchorage from penetrating into the area between the frame members 2 of the reed 9. Here, it would have to be removed later on so as not to hinder the passage of warp threads. It is also conceivable to execute an extended adhesive/spacer bead 13 not only in linear but also in curved form.

FIG. 3 also shows various possible configurations for multi-component frames 20 of the reed 9. Here, the multi-component frames 20 of the reed 9 are asymmetric. The profiles on the warp-thread entry side 41 and the warp-thread exit side 42 extend to different degrees in the elevational direction H. In particular, a first frame profile 21 may be provided with a projection 24. This projection 24 may take on the function of a sealing lip to hinder adhesive for anchoring the multi-component frame 20 of the reed 9 from penetrating into the central area of the reed, in which the warp threads are guided. The warp-thread direction K is shown for purposes of clarity. The warp-thread entry side has been labelled as 41 and the exit side as 42. In another conceivable configuration for the multi-component frame 20 of the reed 9, a profile in the position of the profile 22 in the drawing would be omitted.

Figure 4:
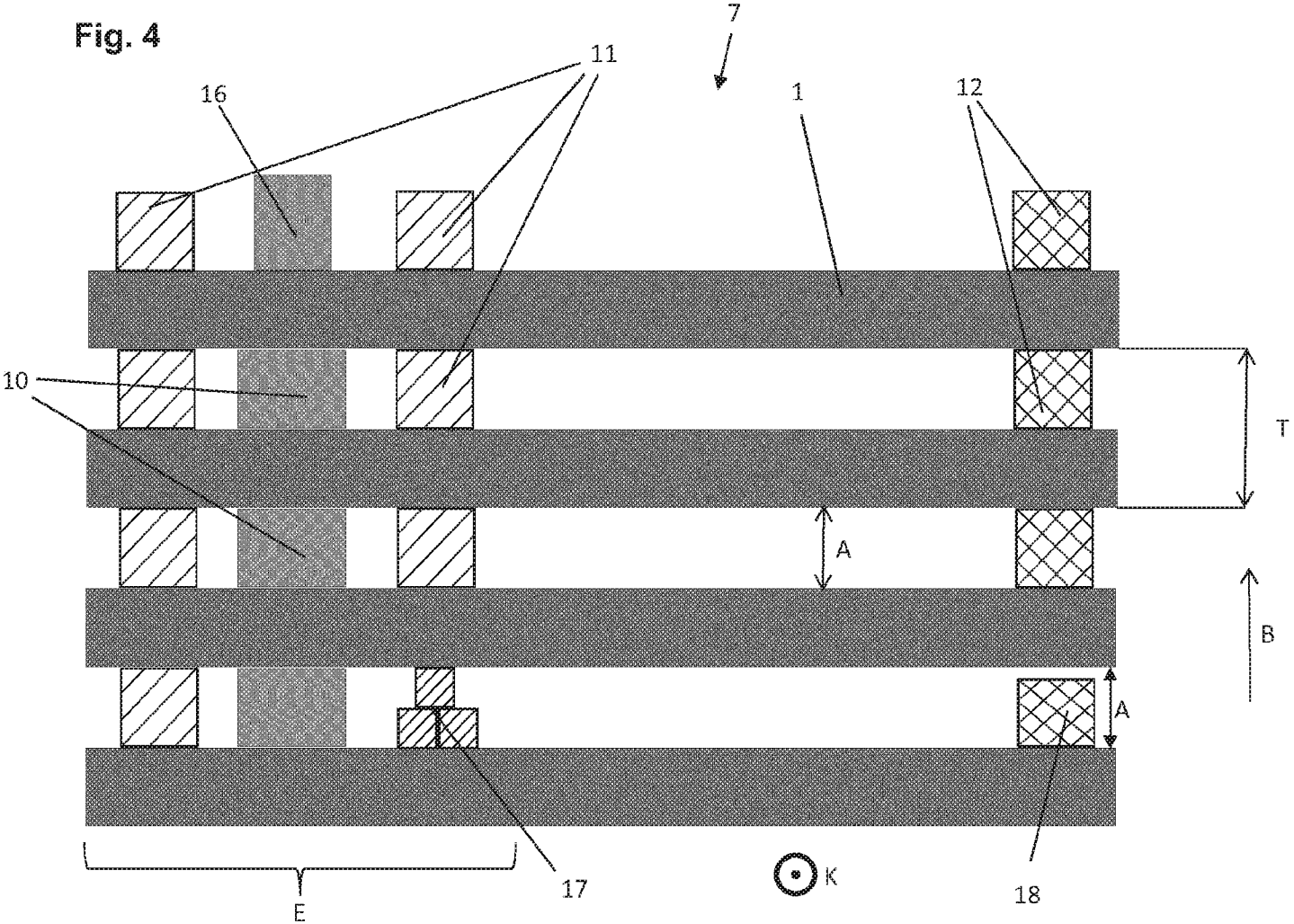
FIG. 4 is a sectional diagram showing a detail of a stack of dents as per the invention for a reed, looking in the warp-thread direction.

FIG. 4 is a schematic sectional diagram in warp-thread direction K showing a detail of a stack 7 of dents 1. FIG. 4 is also simplified: All the adhesive drops and punctiform spacers are shown with a rectangular cross section. Depending on the procedural sequence and on a wide range of parameters, the sides of the adhesive drops and/or punctiform spacers in the sectional view may also be concave or convex. The dents 1 have been cut off at the right-hand edge of the drawing. Moreover, the ratio of the distance between the punctiform spacers 12 in the interspace and the punctiform spacers 11 may be incorrect relative to the shown distance T, (consisting in this context of the dent thickness plus the inter-dent gap width), or at least not correspond to the scale used in FIGS. 2 and 3.

The drawing shows sections of four dents 1. The dent stack 7 is ready for the addition of a fifth dent 1 from above.

It should be mentioned at this point that a reed 9 may have a length of 0.5 m or less up to 4 m or more, and accordingly may have a large number of dents 1. With the method of the invention, there are no upper or lower limits concerning the length of the reed to be manufactured.

As already mentioned, the dent stack 7 shown in the drawing is ready for the addition of a fifth dent from above. Punctiform spacers 11, an adhesive drop 16 which, in this example, is elevated, and an interspace punctiform spacer 12 have already been applied onto the uppermost dent. As explained earlier, all of these punctiform spacers/drops may be applied to the next dent to be added. It is also possible, for example for reasons of procedural efficiency, to apply adhesive/spacers both onto the stack 7 of dents and to the next dent 1 to be added.

FIG. 4 shows two additional examples of advantageous embodiments. An adhesive/spacer stack 17 is shown between the bottom and the next-bottom dent 1. As well as arranging adhesive drops and punctiform spacers beside each other (so as to form beads and expanses), they may also be arranged on top of each other. The drawing also shows a sunken punctiform spacer 18. Particularly where a plurality of different viscous substances is used, different prescribed amounts may be selected, enabling the use of elevated 16 and sunken 18 adhesive drops/punctiform spacers.

Figure 5:
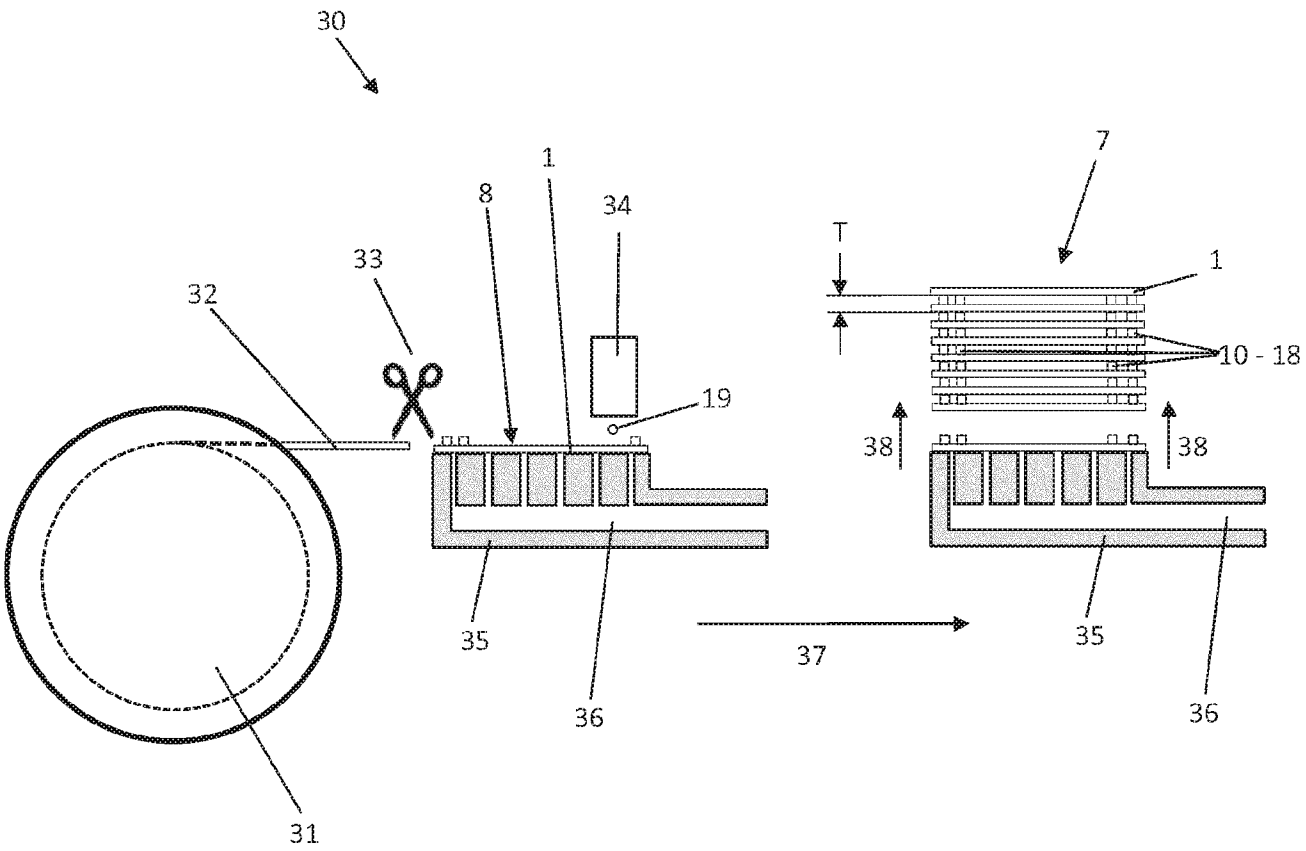
FIG. 5 is a diagram of a device according to the invention.

FIG. 5 is a diagram showing an example of a device 30 according to the invention. Dent strip 32 is fed from a coil 31 of dent strip to a handling device, in this case a vacuum gripper 35. A cutting device 33 separates off a dent 1 from dent strip 32, the dent 1 then being held by a vacuum gripper 35. The vacuum gripper 35 is shown as a diagrammatic cut view, in which the evacuated space 36 of the vacuum gripper 35 is also visible. The vacuum gripper 35 presents an areal surface 8 of the dent 1 to the metering device 34. The metering device 34 applies prescribed amounts of one or more viscous substances to the areal surface 8. Adhesive drops/punctiform spacers 10-18 are already visible on the areal surface 8 of the dent 1, while an adhesive drop/punctiform spacer 19 is still in the air between the metering device 30 and the dent 1. The dent 1 is joined to the dent stack 7 by a further movement in a direction 38. The reed's distance T (dent width plus inter-dent gap width) and the various forms of adhesive drops and punctiform spacers 10-18 are shown.

Figure 6:
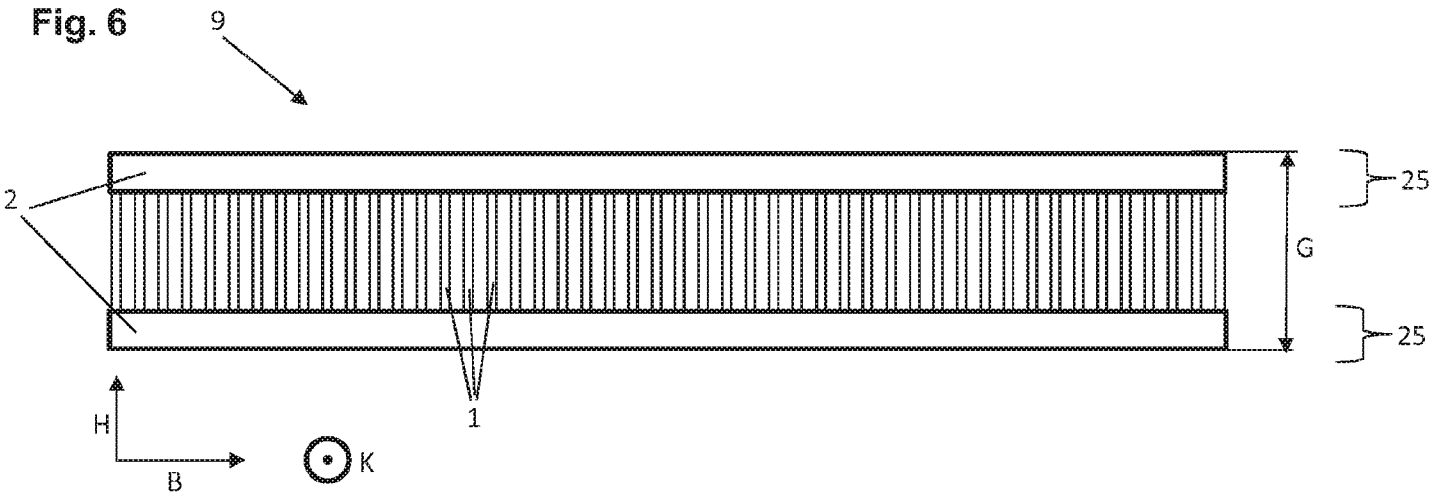
FIG. 6 is a diagram of a reed.

FIG. 6 is a diagram of a reed 9 according to the invention. The overall height G in the elevational direction H, the reed's widthwise direction B and the warp-thread direction K are shown for purposes of clarity. The frame areas 25 of the reed 9 are also shown. The frame areas 25 of the reed 9 are those parts, seen in the elevational direction H, of the reed 9 in which it is not possible for the warp threads to pass through the reed 9. In the reed 9 according to the invention, the frame area begins with the frame members 2, 20. In prior-art reeds, the frame area 25 of the reed 9 begins with the spiral springs 5 or the wires 4, which are wrapped around the dents 1.

Figure 7:
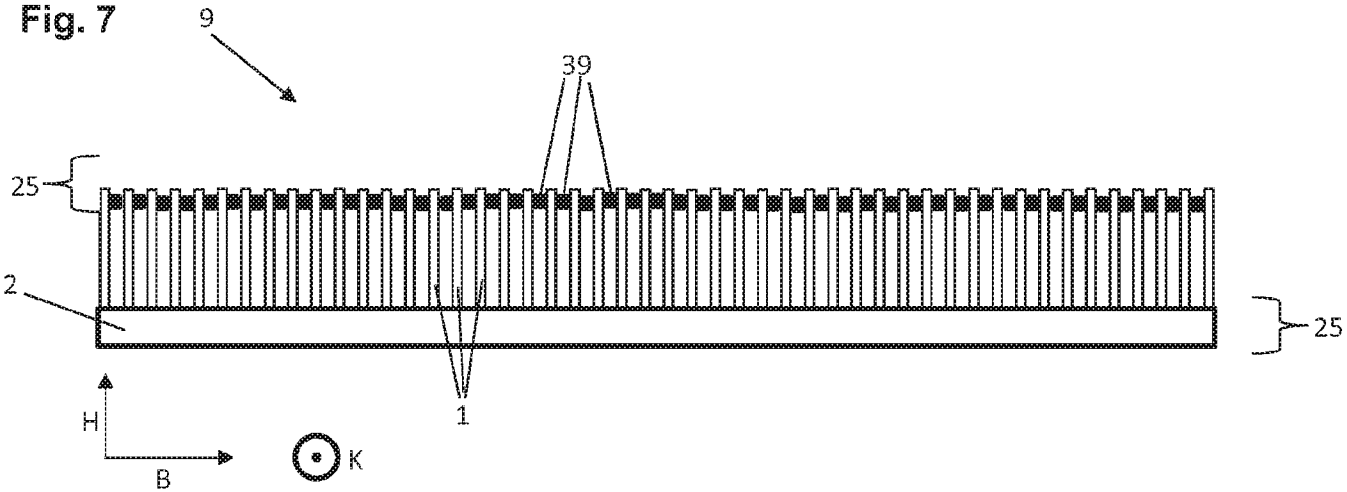
FIG. 7 shows a similar reed to that of FIG. 6.

FIG. 7 is a diagram showing a similar reed 9 to that of FIG. 6. The upper frame member 2 of the reed 9 has been omitted, thereby making the originally viscous (first and additional) bodies 39 visible, which are otherwise concealed by the frame member 2 of the reed 9. In the illustrative embodiment shown in FIG. 7, these originally viscous bodies have the same volume.

List of reference numerals

| | |
|---|---|
| 1 | Dent |
| 2 | Reed frame, U profile |
| 3 | Semi-circular rod |
| 4 | Wire |
| 5 | Spiral spring |
| 6 | Covering of adhesive |
| 7 | Stack of dents |
| 8 | Areal surface of a dent |
| 9 | Reed |
| 10 | Adhesive drop, prescribed amount |
| 11 | Punctiform spacer, prescribed amount |
| 12 | Punctiform spacer in the interspace, prescribed amount |
| 13 | Open-ended bead of adhesive/spacer, prescribed amount |
| 14 | Closed bead of adhesive/spacer, prescribed amount |
| 15 | Expanse of adhesive/spacer, prescribed amount |
| 16 | Elevated drop, bead or expanse of adhesive, prescribed amount |
| 17 | Stack of adhesive/spacer, prescribed amount |
| 18 | Sunken punctiform spacer, prescribed amount |
| 19 | Adhesive drop/punctiform spacer in the air |
| 20 | Multi-component reed frame |
| 21 | First frame profile |
| 22 | Second frame profile |
| 23 | Third frame profile |
| 24 | Projection |
| 25 | Frame/peripheral area of reed |
| 30 | Device |
| 31 | Coil of dent strip |
| 32 | Dent strip |
| 33 | Cutting device |
| 34 | Metering device |
| 35 | Vacuum gripper |
| 36 | Evacuated space in vaccum gripper |
| 37 | Gripper's first direction of movement |
| 38 | Gripper's second direction of movement |
| 39 | Originally viscous (first and additional) body |
| 41 | Warp-thread entry side |
| 42 | Warp-thread exit side |
| A | Inter-dent distance (= gap width) |
| B | Widthwise direction of reed 9, direction perpendicular to the areal surface 8 |
| E | End portions of the dent |
| G | Overall height of the reed 9 |
| H | Elevational direction |
| K | Warp-thread direction |
| T | Distance consisting of dent thickness plus inter- dent gap width |

The invention claimed is:

1. Method for manufacturing weaving reeds (9), the method comprising:

joining together strip- or tape-shaped objects (1) at a given distance apart (A) in a widthwise direction (B) of the reed (9) to form dents (1) of the reed (9), providing, to accurately set a given inter-dent distance, at least one of the strip- or tape-shaped objects (1) with a prescribed amount (10-18) of a first viscous substance applied to an end face of its areal surface (8), which faces in the widthwise direction (B) of the reed (9), joining the strip- or tape-shaped object to a next strip- or tape-shaped object of the strip-or tape-shaped objects, applying to the strip- or tape-shaped object a second amount of an originally viscous embedding compound different from the first viscous substance.

2. Method according to claim 1, further comprising applying the prescribed amount (10-18) of the first viscous substance dropwise (10, 11, 12), layerwise (15), in punctiform manner (10, 11, 12), or in a form of a bead (13, 14).

3. Method according to claim 1, wherein at least one of the strip- or tape-shaped objects (1) is cut to length and has a prescribed amount (10-18) of the first viscous substance applied to at least one of its areal surfaces (8)

and is then brought together with a further strip- or tape-shaped object (1).

4. Method according to claim 1, further comprising forming a permanent joint between at least two strip-or tape-shaped objects (1) with the prescribed amount (10-18) of the first viscous substance.

5. Method according to claim 1, further comprising permanently setting the distance (A) between at least two strip- or tape-shaped objects (1) with the prescribed amount (10-18) of the first viscous substance.

6. Method according to claim 1, wherein the setting of the distance (A) between at least two strip- or tape-shaped objects (1) is effected as early as when the two strip- or tape-shaped objects (1) are initially brought together.

7. Method according to claim 1, further comprising using at least one of the first viscous substance whose curing can be significantly influenced by energy input.

8. Method according to claim 1, further comprising using at least a first and a second viscous substance having different curing properties.

9. Method according to claim 1, further comprising curing at least one of the first viscous substance at least partially before the two strip-or tape-shaped objects (1) are brought together for the first time.

10. Method according to claim 1, further comprising measuring distances between the at least two strip- or tape-shaped objects (1) after they have been brought together and the prescribed amounts (10-18) of the first viscous substance applied and/or the contact pressure used to bring the objects (1) together are controlled according to the distances via an open- or closed-loop control system.

11. Device for joining dents for the production of weaving reeds, the device comprising:

a metering device (34) configured to apply a prescribed amount (10-18) of a first viscous substance and an additional metering device configured to apply an embedding compound to end faces of areal surfaces (8) of the dents (1), wherein the first viscous substance is different from the embedding compound, at least one handling device configured to convey the coated dent from a coating position to a position in which a coated surface of the dent comes into contact with a previously attached dent.

12. Weaving reed comprising:

a plurality of strip- or tape-shaped objects (1), which assume a function of dents (8) and are arranged in a row at a given distance apart (A) in a widthwise direction (B) of the reed (9) and having a first cured, originally viscous embedding compound located at respective end regions of individuals ones of the plurality of strip- or tape-shaped objects (1), at least a first body (39) made of a second prescribed, cured amount of an originally viscous substance, which is located between end faces of areal surfaces (8) of two of the strip- or tape-shaped objects (1) and which is in contact with the areal surfaces (8) of the two strip-or tape-shaped objects (1), wherein the first cured, originally viscous embedding compound is different from the second prescribed, cured amount of an originally viscous substance.

13. Weaving reed according to claim 12, further comprising at least one further body (39), which also comprises a prescribed, cured amount of an originally viscous substance and which has a same volume as the first body.

14. Weaving reed according to claim 12, further comprising:

at least one frame area (25), in which the dents (1) are interconnected, wherein the at least one frame area (25), in which the dents (1) are interconnected, terminates at an end nearer a central portion of the reed (9)—as seen in an elevational direction (H)—on one of the reed's two sides than on an other.

15. Weaving reed according to claim 12, further comprising:

at least one frame area (25), which is bounded in at least two spatial directions by plate-like objects (21, 22, 23), wherein one of the at least one plate-like object (21, 22, 23) bounding the frame area in a first spatial direction of the at least two spatial directions is not formed integrally with at least one of the at least one plate-like object (21, 22, 23) bounding the frame area in a second spatial direction of the at least two spatial directions.

* * * * *